US007882605B2

(12) United States Patent
Senn

(10) Patent No.: US 7,882,605 B2
(45) Date of Patent: Feb. 8, 2011

(54) FASTENING ELEMENT FOR END AREAS OF GARMENTS TO BE FASTENED TO ONE ANOTHER

(75) Inventor: Herbert Senn, Taeuffelen (CH)

(73) Assignee: Brero & Co. AG, Biel (CH)

( * ) Notice: Subject to any disclaimer, the term of this patent is extended or adjusted under 35 U.S.C. 154(b) by 649 days.

(21) Appl. No.: 11/572,172

(22) PCT Filed: Jul. 12, 2005

(86) PCT No.: PCT/CH2005/000399

§ 371 (c)(1),
(2), (4) Date: Jan. 16, 2007

(87) PCT Pub. No.: WO2006/007748

PCT Pub. Date: Jan. 26, 2006

(65) Prior Publication Data

US 2008/0295302 A1 Dec. 4, 2008

(30) Foreign Application Priority Data

Jul. 16, 2004 (DE) ..... 10 2004 034 599

(51) Int. Cl.
*A44B 13/00* (2006.01)

(52) U.S. Cl. ..... 24/697.2; 2/321

(58) Field of Classification Search ..... None
See application file for complete search history.

(56) References Cited

U.S. PATENT DOCUMENTS

| | | | | |
|---|---|---|---|---|
| 2,861,276 | A * | 11/1958 | Alfandre | 112/407 |
| 3,575,750 | A * | 4/1971 | Sakamoto | 156/66 |
| 6,651,254 | B1 | 11/2003 | Chang | |
| 6,820,312 | B1 * | 11/2004 | Senn | 24/697.2 |

FOREIGN PATENT DOCUMENTS

| | | |
|---|---|---|
| EP | 1 180 948 | 2/2002 |
| GB | 876 973 | 9/1961 |
| WO | WO 01/91591 A1 | 12/2001 |

* cited by examiner

*Primary Examiner*—Jack W. Lavinder
(74) *Attorney, Agent, or Firm*—McGlew and Tuttle, P.C.

(57) ABSTRACT

A fastening element is provided for an end area of a first strap of an item of corsetry, particularly of women's undergarments. The fastening element is to be fastened to a second strap of the item of corsetry and has an number of strap plies of which at least one strap ply has a fastening part such as at least one hook, one eye or the like. Comfort of wear is improved for a fastening element of this type with a padding provided between two strap plies. This padding is attached to at least one of the strap plies by joining it near the lateral edges of the fastening element. When the fastening element is in use, the fastening is located, at least in part, between strap plies of the fastening element.

18 Claims, 2 Drawing Sheets

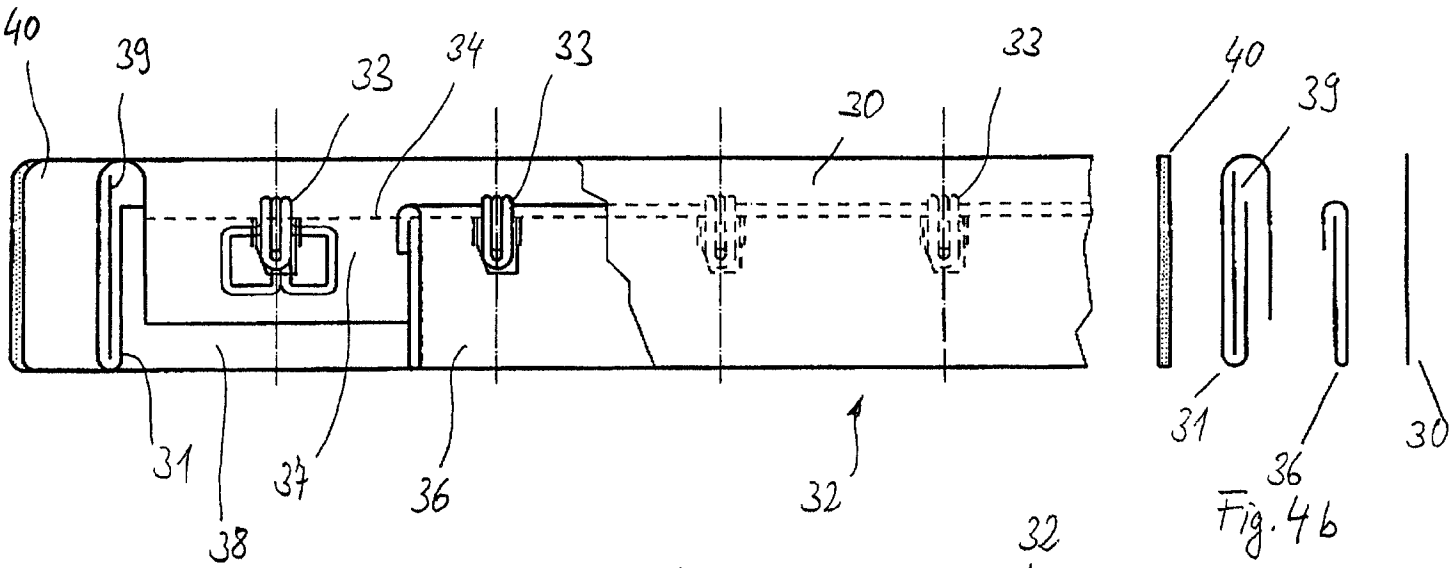
Fig. 4b
Fig. 4a
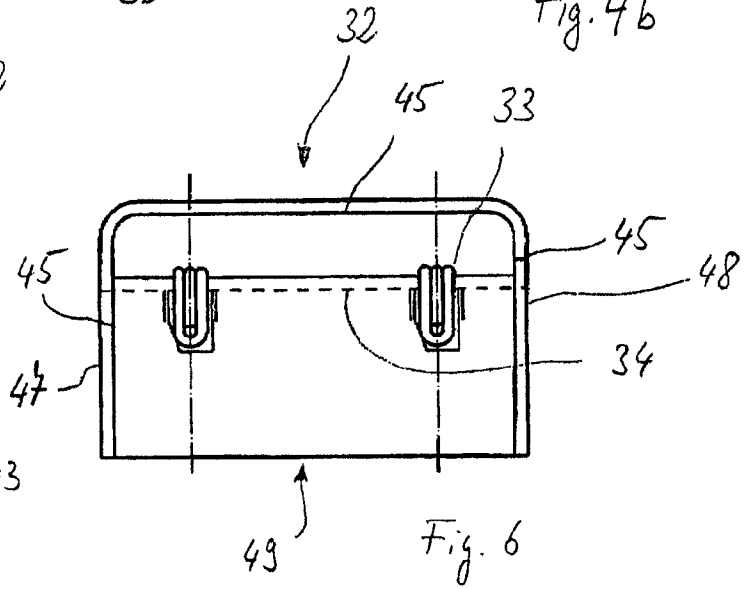
Fig. 6
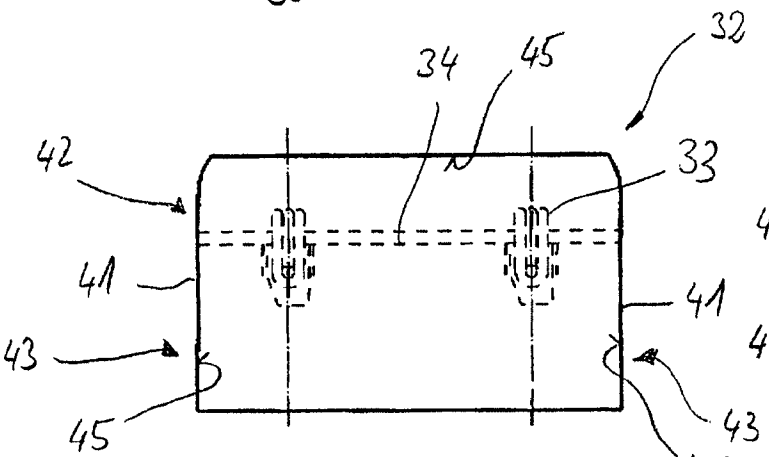
Fig. 5

FASTENING ELEMENT FOR END AREAS OF GARMENTS TO BE FASTENED TO ONE ANOTHER

CROSS REFERENCE TO RELATED APPLICATIONS

This application is a United States National Phase application of International Application PCT/CH2005/000399 and claims the benefit of priority under 35 U.S.C. §119 of German Patent Application DE 10 2004 034 599.6 filed Jul. 16, 2004, the entire contents of which are incorporated herein by reference.

FIELD OF THE INVENTION

The invention relates to a fastening element for end areas of straps of corsetry which are to be fastened to one another, in particular of women's undergarments comprising a plurality of textile plies arranged substantially one above the other, of which at least one strap ply bears a fastening element such as at least one hook, an eye or the like and between two in particular outer strap plies a padding is provided for increasing the comfort of wear, the padding being applied to at least one of the strap plies by joining it near the lateral edges of the fastening element.

BACKGROUND OF THE INVENTION

Such a fastening element is deduced from U.S. Pat. No. 2,861,276 published in 1958 in which a padding should be provided between a rear layer coming in contact with the skin and a further layer which bears the eyes. The layer should improve the comfort of wear of the fastening part. To produce such a fastening part, all the layers are placed upon one another, separated and then bound with an elastic plastic strap on three side edges. To produce a secure fastening, the plastic strap should be vulcanized and pressed under pressure onto the closure part. The padding is only fastened by the outer elastic plastic strap. It is to be feared that the step between the plastic strap and the outer layer will rest on the skin of the user and will press and rub unpleasantly.

Fastening elements are frequently sewn onto the ends of straps and generally formed as an eyelet or eye tape or a hook tape. These eye and hook tapes can be joined together and then jointly form a closure for a garment.

During the manufacture of the eye tapes, the eyes are frequently initially fastened in a known arrangement on an endless base tape by sewing-on. For this purpose a plurality of so-called fold tapes are sewn in a partially overlapping arrangement onto the base tape which is folded-in at both its longitudinal sides, the eyes being fastened on the base tape or the fold tapes during sewing of the fold tapes together with these by seams running substantially parallel to the longitudinal sides of the base tape. The base tape together with the fold tapes secured thereto is then divided into individual sections forming the eye tapes by cuts running transverse to its longitudinal direction.

In the known manufacturing method, the individual eye tapes are separated from the endless base tape by the thermal welding method, for example by an ultrasonic welding method, so that the cut edges of the base tape and the fold tapes are joined to one another at the same time. This type of cutting off of the eye tapes from the endless base tape or the likewise endless fold tapes is simple in terms of manufacturing technology and correspondingly inexpensive. However, since the base tape and the fold tapes are separated from one another by the cuts directed at right angles to their longitudinal sides, these connection edges form the longitudinal-side edges of the eye tapes.

In the case of underwear worn directly on the skin, e.g., in the case of brassieres whose straps lie on the skin with a certain force, there is therefore a risk that the connection edges of the eye tapes, which also lie on the skin, will cut into the skin. This results in an unpleasant feeling during wear, which may also lead to skin irritations.

The conditions are similar in the case of the hook tapes, for the manufacture of which a likewise endless base tape is used. This is first shaped into a kind of tube by folding in its two longitudinal sides, its folded-in areas slightly overlapping and having substantially the same width. The hooks to be arranged in the overlapping area are fastened to the base tape by means of a seam likewise extending substantially parallel to the longitudinal sides of the base tape, all layers of the base tape lying one on top of another being connected to one another simultaneously.

The base tape with the hooks fastened thereto is divided into individual sections forming the hook tapes by cuts extending at right angles to the longitudinal direction as well. Before the cutting off of the individual hook tapes, the base tape is folded essentially centrally around a folding edge extending substantial parallel to its longitudinal direction, and its area carrying the hooks lies on the area that is free from hooks.

If the separation of the individual hook tapes from the endless base tape is likewise carried out according to the thermal welding method, the cut edges of the areas of the base tape located one on top of another are connected to one another by the separation operation. Since the cut edges extend at right angles to the longitudinal sides of the base tape in this case as well, these connection edges also form the front-side edges of the hook tapes thus prepared. Thus, the connection edges of the hook tapes also cause an unpleasant feeling during wear, which may lead to skin irritations, in the case of underwear to be worn directly on the skin.

In order to provide better comfort of wear in connection with such fastening elements, it is proposed in EP 1 180 948 B1 that a base tape carrying a plurality of closure parts, namely hooks, should be folded parallel to the longitudinal profile of the base tape. By this means the closure parts arrive at the inner side of the folded base tape. Closure elements are then cut off from the base tape by separating weld seams running at right angles to the longitudinal profile of the base tape. By turning over the closure elements thus produced, the closure parts arrive at the outside on one hand and the sharp edges of the separating weld seams arrive at the inner side of the closure elements. The sharp edges thus cannot rest on the skin and cause irritation there.

In an alternative embodiment of EP 1 180 948, a cover tape is placed on an eye-carrying side of the base tape. Accordingly, fastening elements are also separated with separating weld seams here and at the same time, the two layers of each fastening element are joined together at three longitudinal edges. Here also, the sharp separating weld seams are brought to an inner side of the fastening element where they cause no irritation, by turning over. Despite the significantly improved comfort of wear, these fastening elements also cannot be completely satisfactory with regard to comfort of wear.

SUMMARY OF THE INVENTION

It is thus the object of the invention to provide fastening elements of the type specified initially which exhibit improved comfort of wear despite manufacture being as inexpensive as possible.

This object is achieved by a fastening element of the type specified initially according to the invention whereby when the fastening element is in the usage state, the fastening of strap plies is located at least partly between strap plies of the fastening element. The object is additionally achieved by a method according to the invention.

The invention thus envisages to provide a fastening element with a padding, to attach the padding to the fastening element with a join and to dispose the join, for example a seam, which is perceived as irritating, between strap plies in the interior of the fastening element. Other than in the generic previously known fastening elements, despite the padding, the seam required to attach the padding to the fastening element can be brought according to the invention outside the area of skin contact with the user. In the usage state of the fastening element, the join is preferably not accessible and is covered with strap plies.

In connection with the invention, the terms "strap ply" and "padding" are used to describe endless tapes such as are usually used in the manufacture of fastening elements and also for sections of endless tapes which are cut off from the endless tapes as part of the manufacturing process of the fastening elements.

Particular advantages can be achieved if the padding can be brought into a different position relative to the strap plies preferably by turning over the at least two strap plies which can preferably be formed as textile plies. By this means, for example it is possible to place the padding (or a padding tape) for its attachment to the fastening element initially on an outer side of the fastening element, to make the join and then bring the padding into a position between two strap plies of the fastening element, In this position, the padding can fulfill its pressure-alleviating function particularly effectively. As a result of the turning over, the join of the padding which is usually irritating, can at the same time be brought into the position between the strap plies. In this position, preferably no direct contact should be possible between the join and the person using the underwear.

Other than is the case in U.S. Pat. No. 2,861,276, for example, it is additionally possible according to the invention to produce a completely flat contact area between the fastening element and the skin of the user, whereby the contact area of the fastening element can rest completely on the skin without any irritating steps.

In a preferred embodiment of the invention, in this case the padding can be brought into a pocket which is obtained from two strap plies of the fastening element which are joined together. Since it is very difficult and time-consuming to insert the padding by hand into the pocket as a result of the textile plies becoming hooked with the padding, the turning=back/turning-over process presents a rapid, reliable and nevertheless very simple possibility for the arrangement of the padding inside the pocket.

The padding can preferably comprise a compressible material, such as foam material, for example which reduces the feeling of pressure perceived by the wearer of the garments in the area of the fastening element. However, in principle, any other material which helps to improve the comfort of wear, for example, fleece material, Nylon, velour, microfibre, silicone and others can be used as padding.

Since the two strap or textile plies are preferably joined together with at least one joining seam the joining seam produced before the turning-back/turning-over process is additionally brought at least partly, preferably completely, into the pocket. As a result, the mostly sharp-edged joining seam has no skin contact and therefore also does not lead to any deterioration in the wearing comfort of the item of corsetry. Since the invention preferably relates to fastening elements and their methods of manufacture as described in EP 1 180 948 B1, its disclosure content is herewith completely included by reference.

In a preferred embodiment, the joining seam of the strap plies is also used to join the padding to the fastening element. As in other embodiments according to the invention, this fixing can, on the one hand, reliably prevent unintentional withdrawal or slipping-out of the padding from the fastening element or undesirable folding of the padding inside the pocket. On the other hand, for reliable fixing of the padding it is not necessary to completely close the pocket for which an additional operation would be required. In addition, in this way all the strap plies of the fastening element can be joined together in one operation.

If, during the manufacture of the fastening elements, the two strap plies as well as the padding tape are placed one upon the other and at the same time, the respective sections for the respective fastening element are cut off from these tapes, it is possible to carry out the shaping for all the layers of the fastening element in only one operation. By means of a separating welding process, the individual plies can be joined to one another additionally and substantially at the same time using the same single operation.

Further preferred embodiments of the invention are obtained from the claims, the description and the drawings.

The invention is explained in detail with reference to exemplary embodiments shown purely schematically in the figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 4*a* is a schematic view showing a base tape of a hook tape provided with hooks as endless tape with folded ends, having a padding tape resting against its underside and a cover tape resting against its upper side;

FIG. 4*b* is a cross-sectional view of FIG. 4*a;*

FIG. 5 is a schematic view showing a cut-off section of the endless tapes from FIG. 4;

FIG. 6 is a schematic view showing the hook tape after the turning-back/turning-over process.

DESCRIPTION OF THE PREFERRED EMBODIMENTS

Figure 1:
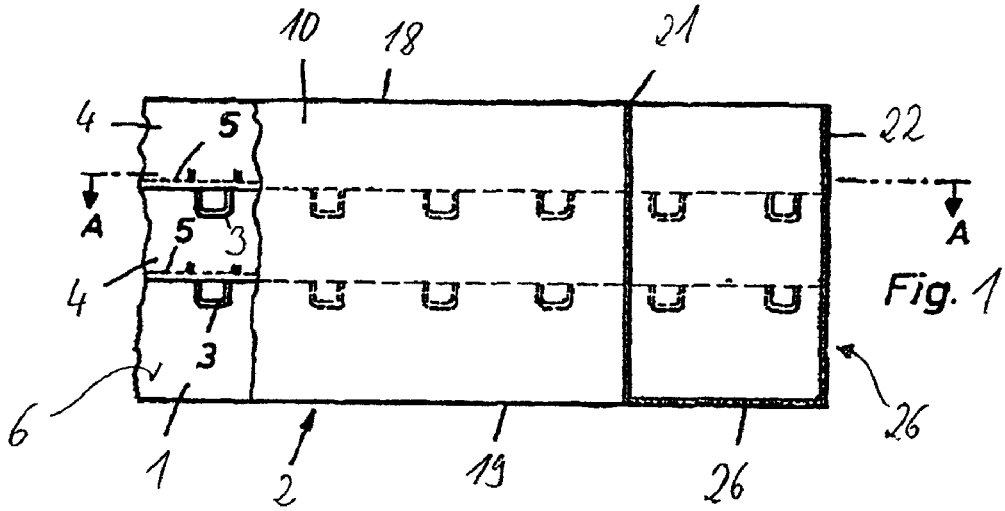
FIG. 1 is a schematic view showing a base tape provided with eyes, on one side whereof a cover tape is located and on the other side whereof a padding tape is located, all the tapes being endless tape.
Figure 2:
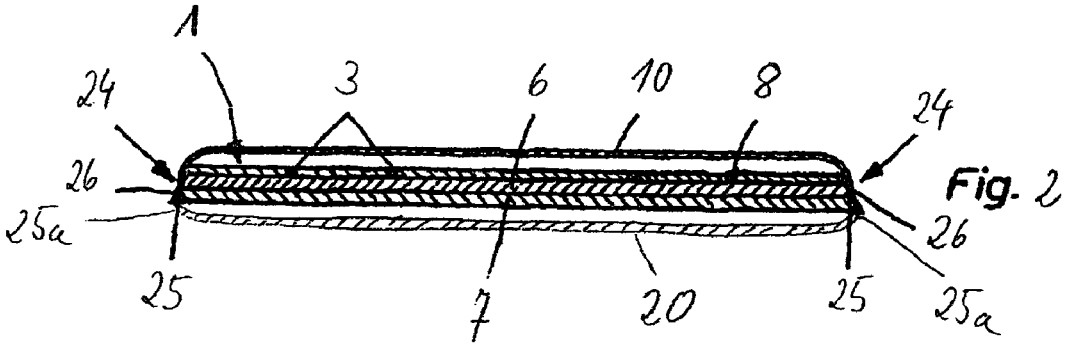
FIG. 2 is a schematic view showing a section along line A-A in FIG. 1 with welded-on cover tape and padding tape.
Figure 3:
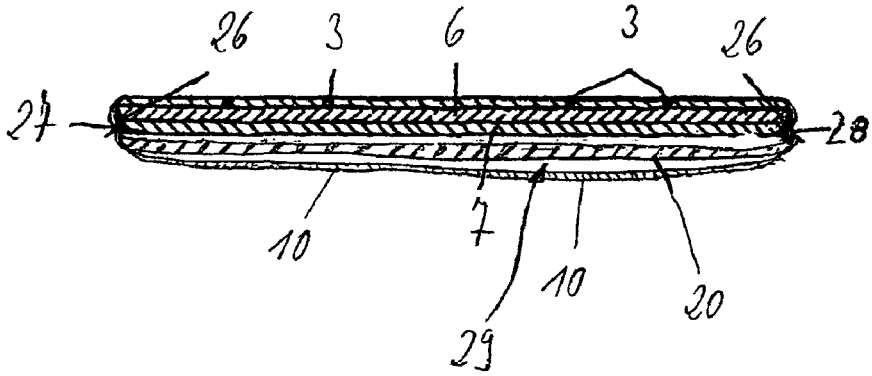
FIG. 3 is a schematic view showing an eye tape after a turning-back/turning-over process.

Referring to the drawings in particular, FIG. 1 shows a base tape 1 of an eye tape 2 which is provided with eyes 3 at pre-determined intervals. As can be seen from FIG. 1, a plurality of fold tapes 4 running parallel to its longitudinal axis is sewn onto the base tape 1 by means of fastening seams 5 running parallel to the tapes. The fastening seams 5 serve at the same time to fasten the eye 3 on the base tape 1, whose longitudinal axis runs substantially at right angles to the longitudinal axis of the base tape 1. The latter thus has an eye-carrying region 6 on its one side and an eye-free region 7 on its other side.

The base tape 1 is preferably made of a soft material and can be formed from a flat tape whose side regions not shown in detail in the drawing are folded onto one another and overlap by a certain amount. The base tape 1 thus forms a tubular structure with overlapping abutting edges. A stabilizing tape 8 can be provided inside the base tape. In this case, the stabilizing tape 8 merely has the function of imparting a greater stiffness to the base tape. The stabilizing tape is preferably located completely inside the base tape 1 and is joined to this as a result of the fastening seams of the fastening parts. Turn-over edges 18, 19 of the base tape 1 form the two front boundaries of the eye tape 2 relative to the usage position of the eye tape 2 when used in brassieres.

As can be seen from FIG. 1, a preferably elastic cover tape 10 which covers the eyes 3 is placed on the eye-carrying region 6 of the base tape. In the case of the exemplary embodiment, the cover tape 10 consists of LYCRA (Dupont trademark) or a material having comparable properties. A padding tape 20 is placed on the side of the eye-free region 7. In the exemplary embodiment the padding tape 20 consists of foam. Preferably, as in the example shown this can comprise a synthetic weldable foam. Such foams are supplied, for example, by Recticel, Belgium. With reference to the cover tape 1 with the sewn-on fold tapes 4, the cover tape 10 thus lies on its one side and the padding tape 20 on its other side.

In this position of base tape 1, cover tape 10 and padding tape 20, a thermal welding process, for example, an ultrasonic welding process is used to cut consecutive sections of pre-determined length from the base tape 1, cover tape 10 and padding tape 20. The length of these sections determines the height and width of the eye tape, for example in a brassiere, relative to the usage position of the eye tape 2 to be produced.

The separating welding tool to be used (not shown) can thus be embodied such that during the separating process, it forms a separating weld seam 21 or 22 both at a first section and at a second section following this. Optionally, a transverse weld seam can also be formed between the two separating weld seams 21, 22 so that the separated section can at least be substantially closed in the area of three of its side edges.

The cut edges of the eye tape 2 thus formed are thereby welded with the cut edges 24 of the cover tape 10 and the cut edges 25*a* of the padding tape 20. Among other things, these separating weld seams have the function of at least a part of a join between the padding and at least one of the strap plies which fixes the padding on the fastening element. This results in each case in a strengthened and very sharply defined joining edge 26 which is located on the respective outer side of the corresponding section. In each case, the eyes 3 are always still covered by the cover tape 10 which is now welded-on.

As a result of a following turning-over/turning-back process, the section is turned over/turned back in such a manner that the cover tape 10 is brought from the eye-carrying region 6 to the eye-free region 7. The eyes 3 are hereby exposed. At the same time, the joining edges 26 (separating weld seams) are brought into the interior of the finished eye tape so that the two limiting edges 27, 28 of the eye tape 2, which come in contact with the skin in the usage position of the eye tape, are substantially formed by the cover tape 10.

At the same time, the separated section of the padding tape 20 is brought as padding between the cover tape 10 and the base tape 1. In this case, the padding is fixed to the fastening element thus produced at three or four side edges via the fastening edge 26. It is neither necessary to insert the padding into the pocket 29 formed by the separated sections of the cover tape 10 and the base tape 1 nor is there any risk that the padding is unintentionally removed from the pocket.

The eye tape 2 thus formed can be sewn in a manner known per se onto the strap of a garment, for example, onto a strap of a brassiere. In this case, relative to the usage position of the brassiere, the two longer limiting edges form the upper and lower region of the eye tape 2 sewn onto the strap. Preferably as a result of an increased compressibility of the fastening element according the invention in relation to its thickness, the wearing comfort of the garment can be increased with the padding. The individual fastening parts and the joining seam can press through onto the skin to a lesser extent with the fastening elements according to the invention and as such are barely perceived by the wearer of the garment.

FIG. 4*a* shows the various endless strap plies of an exemplary embodiment for a hook tape 32 which is provided with hooks 33 at pre-determined intervals. These hooks 33 are fastened on the base tape 31 by means of a fastening seam 34 running substantially parallel to the longitudinal axis of the base tape 31, its longitudinal axis (longitudinal extension) running substantially at right angles to the longitudinal axis of the base tape 31. The hooks 33 are sewn onto the base tape together with a fold tape 36. In the exemplary embodiment, the base tape 31 loops once completely around a stabilizing tape 39, whereby the two side regions of the base tape 31 overlap on the hook side of the base tape and come to rest one upon the other. The stabilizing tape 39 is thus arranged completely inside the base tape 31. The upper side region of the base tape 31 with the hooks 33 lies on the lower side region and could be turned over inwards again to form a clean edge. The fastening seam 34 serves at the same time for fixing these folds of the base tape 31 which thus forms a tubular structure with overlapping abutting edges. The upper side region thus forms a hook-carrying region 37 whilst the lower side region forms a hook-free region 38. In principle, the regions 37 and 38 can be different sizes or the same size.

As shown on the right-hand side of the diagram in FIG. 4*a*, a cover tape 30 lies parallel on the base tape 31 with sewn-on hooks and the sewn-on fold tape 36, the cover tape preferably comprising elastic material such as LYCRA, for example. The base tape 31 as well as the hooks 33 are covered by the cover tape 30 and are thus shown by dashed lines in this part of FIG. 4*a*.

The padding tape 40 which can be identified on the left in FIG. 4*a* is located on the other side (in the diagram in FIG. 4*a*, the underside pointing towards the surface of the drawing) of the base tape. The padding tape 40, for example, made of elastic compressible foam, preferably has the same width as the base tape 31 when folded. From bottom to top, the padding tape 40 thus rests against the base tape 31 carrying hooks 30 and this base tape 31 with the sewn-on fold tape abuts against the cover tape 30.

In this position of the regions 37 and 38, and the padding tape 40, successive sections of pre-determined length are separated substantially at the same time from the base tape 31, padding tape 40 and cover tape 30 by means of a thermal welding method, for example, by means of ultrasound. Such a separated section is shown in FIG. 5. The length of these sections determines the height or the width of the hook tape 32 relative to the usage position of the hook tape 32 to be produced, for example, in brassieres.

The separating welding tool (not shown) to be used for this purpose can thus be embodied such that during the separating process, it forms a separating weld seam 41 both at a first section and at a second section following this. The cut edges 42 of the base tape thereby formed are thus welded to the cut edges 43 of the cover tape 30 and the padding tape 40, in each forming a strengthened and very sharply defined joining edge which is located on the respective outer side of the corresponding section. In this case, the hooks 33 are always still covered by the cover tape 30 which is indicated by dashed lines for the hooks 33 and the fold edge of the fold tape 36 in FIG. 5.

As a result of a following turning-over/turning-back process, the separated section is turned over/turned back around the part of the joining edge 45 opposite to the opening (side edge 49) of the pocket in such a manner that on the one hand, the hooks 33 are released from the cover tape 30 and on the other hand, the joining edges 45 (separating weld seams) are brought into the interior of the hook tape 32 (FIG. 6). By this means, the two limiting edges 47, 48 of the hook tape which come in contact with the skin in the usage position of the hook tape, are formed by the material of the base tape 31. At the same time, the separated sections of the padding tape 40 which are welded to the hook tape are brought between the base tape 31 and the cover tape 30. In this exemplary embodiment the previously separated sections of the base tape 31 and the cover tape form the pocket which is open along the side edge 49 in which the section of the padding tape 40 formed as padding is located.

The hook tape 32 thus produced can be sewn in a manner known per se onto the strap of a garment, for example, onto a strap of a brassiere. In this case, the two limiting edges 47, 48 form the upper and lower region of the hook tape sewn onto the strap, relative to the usage position of the brassiere.

It has been assumed hereinbefore that respectively one separating weld seam is formed when separating the individual sections both from the hook tape and from the eye tape at respectively two section. This can be achieved using a relatively simple separating welding tool. In addition, any waste on the base tape is avoided in this case.

However, it is naturally also within the scope of the invention to use respectively one forming/separating welding tool for cutting off the individual sections from the hook tape or from the eye tape. It is thus possible to form the respectively two separating weld seams at the same time on the respective section.

The forming/separating welding tool used for cutting off the sections from the base tape of the hook tape or eye tape then only needs to be provided with two rectilinear sonotrodes to be arranged at the distance of the length of the individual sections.

For cutting off the sections from the base tape of the eye tape it is possible to use a substantially U-shaped sonotrode or a U-shaped separating slitter whereby the two longitudinal separating weld seams and at the same time a transverse separating weld seam extending therebetween can be produced at the same time. The transverse separating weld seam can alternatively be formed as a normal weld seam, i.e. not as a separating weld seam.

In another embodiment, a fastening element can be separated from the strap plies using only one separating tool comprising only one sonotrode and one separating slitter. In this case, one of the two longitudinal separating weld seams is formed in the cutting region both at the fastening element currently being cut and at the next successive fastening element. For example, by turning the cut-off fastening element through 90°, the transverse separating weld seam can be formed subsequently using the same or a second separating tool (sonotrode and separating slitter). In order to achieve a uniform edge profile which is as narrow as possible, protruding material of the strap plies at the transverse separating weld seam can be cut of. It is thereby possible to avoid any raising of the transverse separating weld seam after the turning-over/turning-back process in the pocket.

As a result of the process which has been described, a strengthened fastening edge is formed in the region of the corresponding turn-over edge which can initially be considered as disadvantageous. However, since this fastening edge is brought between the eye-free region and the cover tape or the padding tape as a result of the turning-over/turning-back process of the eye tape, the fastening edge has no negative influence on the wearing comfort. At the same time, the advantage is achieved that the corresponding turn-over edge is strengthened.

While specific embodiments of the invention have been shown and described in detail to illustrate the application of the principles of the invention, it will be understood that the invention may be embodied otherwise without departing from such principles.

The invention claimed is:

1. A fastening element for an end area of a first strap of a garment, which is to be fastened to a second strap of the garment, the fastening element comprising:

a fastening component;

a plurality of strap plies, of which at least one of said strap piles bears said fastening component; and a padding provided between two of said strap plies for increasing the comfort of wear, said padding being applied to at least one of said strap plies, wherein at least one joining seam extends along an edge of said padding, said joining seam fastening said two of said strap plies and said padding to each other, said joining seam being covered with said two of said strap plies, wherein said padding element is at least partially arranged between said two of said strap plies.

2. The fastening element according to claim 1, wherein said two of said strap plies form a pocket wherein the padding and the fastening component are located at least partly inside the pocket.

3. The fastening element according to claim 1, wherein the at least one joining seam is located at least partly inside the pocket when in use.

4. The fastening element according to claim 1, wherein the padding is fixed with at least one section of the joining seam on the fastening component.

5. The fastening element according to claim 1, wherein the joining seam is a weld seam.

6. The fastening element according to claim 1, wherein in a manufacturing state before producing a usage state, the fastening component is located in the area of at least one upper side of an outer strap ply in this manufacturing state.

7. The fastening element according to claim 1, wherein the padding is brought between two strap plies by turning over/turning back at least one of the strap plies between two strap plies.

8. The fastening element according to claim 1, wherein the padding is a compressible foam material.

9. The fastening element according to claim 1, wherein one strap ply comprises a base tape onto which at least one fold tape, comprising a plurality of said fastening components, is sewn.

10. A method for producing a fastening element for items of corsetry, the method comprising:

placing at least two strap plies one upon the other to form a strap ply structure, at least one of said two strap plies comprising fastening parts;

in each case joining one section of one of said at least two strap plies together with one section of another one of said at least two strap plies to form a connected section of said strap ply structure and separating said connected section from said strap ply structure;

providing a padding for improving comfort of wear;

fastening said padding to at least one of said at least two strap plies via a joining seam;

bringing said padding together with said joining seam between the sections of the two strap plies.

11. The method according to claim 10, wherein said joining seam is a separating weld seam to the sections of the at least two strap plies.

12. The method according to claim 10, wherein a padding tape is disposed on one of the two strap plies and at least substantially at the same time as the separation of the two sections of the strap plies, a padding is also separated from the padding tape.

13. The method according to claim 12, wherein the padding tape is placed on said at least one of said two strap plies comprising fastening parts.

14. The method according to claim 12, wherein the padding is fastened at least substantially at the same time as producing the joining seam of the two sections of the strap plies at this joining seam.

15. The method according to claim 10, wherein a separating welding process in which sections of the two strap plies and the padding tape are separated and welded together at the same time.

16. The method according to claim 10, wherein the fastening element is brought into a usage state and the padding is brought between the two sections of the strap plies by a turning-back/turning-over step.

17. A method for producing a fastening element for items of corsetry, the method comprising:

providing a first strap;

providing a second strap, said second strap comprising fastening parts;

providing a padding element;

placing said first strap on said second strap to form a strap ply, said fastening parts being located between said second strap and said first strap;

arranging said padding element adjacent to said second strap;

joining at least one section of said first strap with at least one section of said second strap and at least one section of said padding element via a joining seam to form a connected section of said strap ply and separating said connected section from said strap ply to form a separated connected strap ply section;

performing a turning over process on said separated connected strap ply section such that said padding element is located between said first strap and said second strap and said joining seam is located within an interior space defined by one or more of said first strap, said second strap and said padding element, said joining seam being located along an outer edge of said at least one section of said first strap, said at least one section of said second strap and said at least one section of said padding element prior to said turning over process.

18. The method according to claim 17, wherein said first strap is located opposite said fastening parts prior to performing said turning over process, said second strap being located opposite said padding element prior to performing said turning over process, said first strap being located opposite said padding element after performing said turning over process, said fastening parts not being covered by said first strap after performing said turning over process.

* * * * *